United States Patent [19]

Box

[11] Patent Number: 4,993,554

[45] Date of Patent: Feb. 19, 1991

[54] NESTABLE BEVERAGE CASE

[75] Inventor: Thomas Box, Tinton Falls, N.J.

[73] Assignee: Spectrum International, Inc., Tinton Falls, N.J.

[21] Appl. No.: 108,147

[22] Filed: Oct. 14, 1987

[51] Int. Cl.[5] ..... B65D 21/04

[52] U.S. Cl. ..... 206/507

[58] Field of Search ..... 206/505, 507

[56] References Cited

U.S. PATENT DOCUMENTS

| | | | |
|---|---|---|---|
| D. 242,600 | 12/1976 | Box . | |
| D. 245,760 | 9/1977 | Box . | |
| D. 258,803 | 4/1981 | Box . | |
| D. 259,294 | 5/1981 | Box . | |
| D. 261,194 | 10/1981 | Box . | |
| D. 265,009 | 6/1982 | Box . | |
| D. 266,709 | 10/1982 | Box . | |
| 3,361,293 | 1/1968 | Box . | |
| 3,387,740 | 6/1968 | Bockenstette | 206/505 |
| 3,392,875 | 7/1968 | Bockenstette . | |
| 3,425,594 | 2/1969 | Bridenstine . | |
| 3,568,879 | 3/1971 | Box . | |
| 3,628,684 | 12/1971 | Sere . | |
| 3,655,088 | 4/1972 | Box . | |
| 3,659,743 | 5/1972 | Box . | |
| 3,675,815 | 7/1972 | Rehrig . | |
| 3,682,351 | 8/1972 | De Putter . | |
| 3,934,724 | 1/1976 | Johnson | 206/507 |
| 3,997,055 | 12/1976 | Box . | |
| 3,998,327 | 12/1976 | Box . | |
| 3,998,328 | 12/1976 | Box . | |
| 4,023,680 | 5/1977 | Thurman | 206/507 |
| 4,106,624 | 8/1978 | Thurman | 206/507 |
| 4,190,172 | 2/1980 | Box . | |
| 4,197,958 | 4/1980 | Zeni et al. . | |
| 4,254,594 | 2/1969 | Bridenstine | 206/507 |
| 4,320,845 | 3/1982 | Waller . | |
| 4,441,615 | 4/1984 | Goodrich . | |
| 4,478,156 | 10/1984 | Andersson . | |
| 4,523,681 | 6/1985 | Kreeger | 206/507 |
| 4,548,320 | 10/1985 | Box . | |

FOREIGN PATENT DOCUMENTS

| | | | |
|---|---|---|---|
| 663134 | 8/1965 | Belgium | 206/507 |
| 2805880 | 2/1979 | Fed. Rep. of Germany . | |
| 1512202 | 1/1968 | France . | |

*Primary Examiner*—George E. Lowrance

*Attorney, Agent, or Firm*—Hedman, Gibson, Costigan & Hoare

[57] ABSTRACT

A beverage case that can be nested or stacked is disclosed. The beverage case has two later sides of full height and two longitudinal sides. The longitudinal sides extend upwardly from the bottom of the case to a height less than one-half the height of the lateral sides, and have central panel sections of a length greater than the length of the lateral sides. The central panel sections each have an intermediate recess.

9 Claims, 5 Drawing Sheets

NESTABLE BEVERAGE CASE

FIELD OF THE INVENTION

The invention relates to beverage cases. More particularly, the invention relates to a beverage case that can be stacked when filled with beverage containers and also nested when empty.

BACKGROUND OF THE INVENTION

Beverage cases have been used for transporting and storing containers such as bottles and cartons of beverages for a long while. Wooden and combination wooden and metal beverage cases have long been used to transport and store milk bottles and milk cartons.

More recently, beverage cases formed of plastic such as polypropylene, polyethylene or similar materials have become common. Typically, these beverage cases are loaded with full cartons or bottles and stacked on top of each other to make maximum use of storage and transportation space. The stacks of beverage cases are five or six high.

In the past, the beverage cases generally were square or rectangular with four full sides that formed a continuous upper surface on which another beverage case could rest. Thus, the beverage cases, whether full or empty, could only be stacked with the bottom surface of one beverage case resting on another beverage case.

The solid structure of the beverage cases was found to be important because of the heavy duty to which the beverage case are subjected during handling. Customarily, the beverage cases are stacked five high, a hook is inserted into a handle opening, the stack of beverage cases is tilted slightly away from the hook side and dragged across a floor surface.

At the terminal location, the column of stacked beverage cases is dismantled to facilitate removal of the cartons or bottles from each beverage case.

SUMMARY OF THE INVENTION

It is an object of the present invention to provide a beverage case that can be stacked when full and also nested when empty.

It is another object of the invention to provide a beverage case that can be nested in an orientation that occupies less space than a column of stacked beverage cases.

It is still a further object of the present invention to provide a beverage case that has access openings for removing containers from a stacked column without dismantling a stacked column of beverage cases.

It is also an object of the invention to provide a structurally sound beverage case capable of withstanding the heavy duty handling that typically attends transporting beverage cases.

As a result, a beverage container is provided with a rectangular configuration having two full lateral sides and two short longitudinal sides. Each corner of the beverage case is formed of reinforced members that extend from the top of the beverage case to the bottom. The edges on the longitudinal side of the reinforced corner members are spaced apart a distance slightly greater than the length of the lateral sides. The upper edge of the longitudinal sides is at a height between one-third and one-half the height of the lateral sides. Thus, a U-shaped beverage case is presented when viewed from the longitudinal side, the opening adapted to nestingly accommodate another beverage case placed transversely in the opening.

Further, longitudinal sides are provided with an intermediately disposed depression that facilitates removal of cartons or bottles from the beverage case container when the beverage containers are in a stacked column. Additionally, each container is provided with upper and lower mating inclined edges and four extensions on the bottom adapted to align with and enter into four mating recesses in the upper surface of the beverage container.

DESCRIPTION OF THE DRAWINGS

The invention will be better understood when considered with the following drawings wherein.

DESCRIPTION OF THE PREFERRED EMBODIMENT

Figure 1:
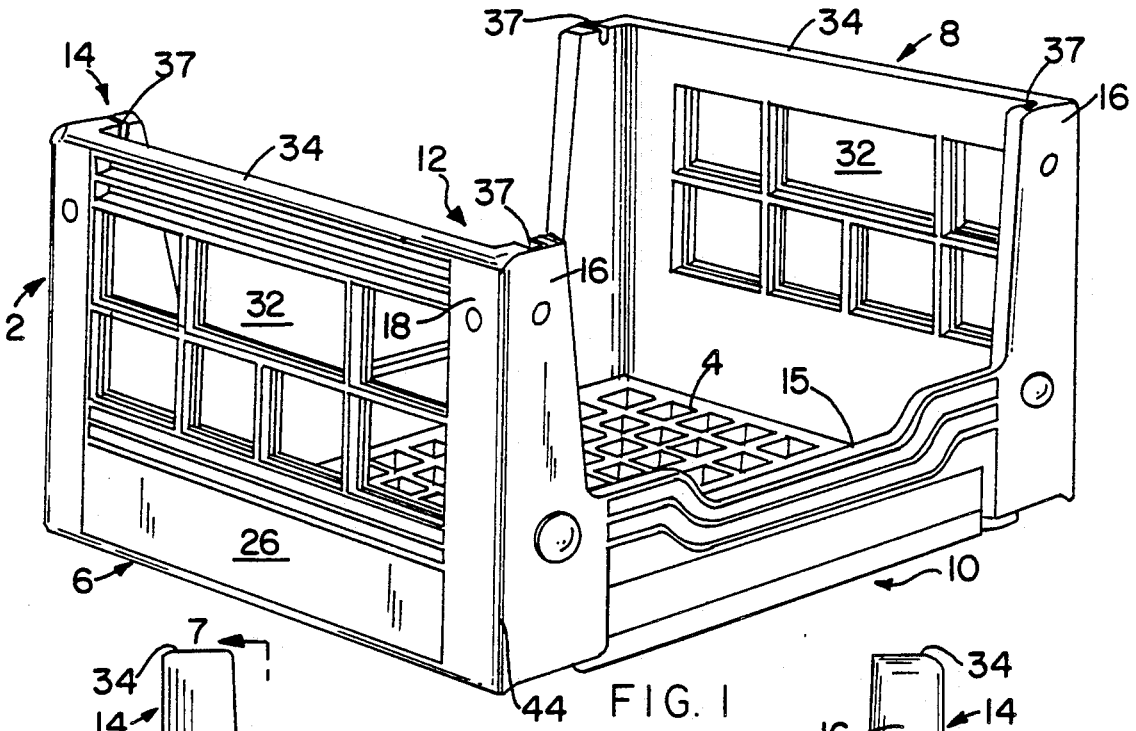
FIG. 1 is an isometric view of the beverage case of the invention.

The beverage case 2 of the present invention, seen in perspective in FIG. 1, is provided with a bottom 4 on which the beverage containers are supported, lateral sides 6 and 8 and longitudinal sides 10 and 12. Each corner of the beverage case has an identically formed reinforcing member 14 formed of a longitudinal side section 16 and a lateral side section 18.

Figure 2:
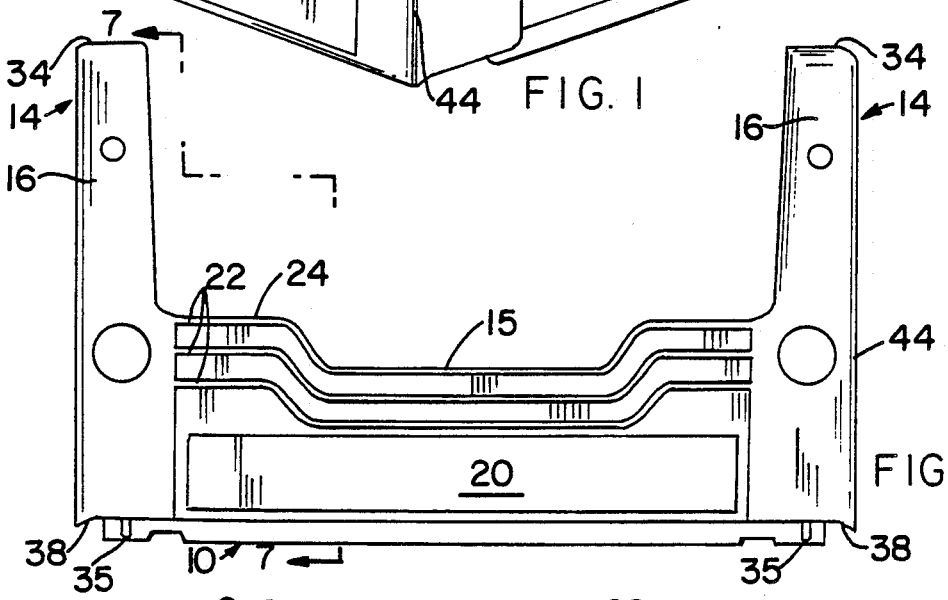
FIG. 2 is an elevational view of the longitudinal side of the beverage case of FIG. 1.
Figure 7:
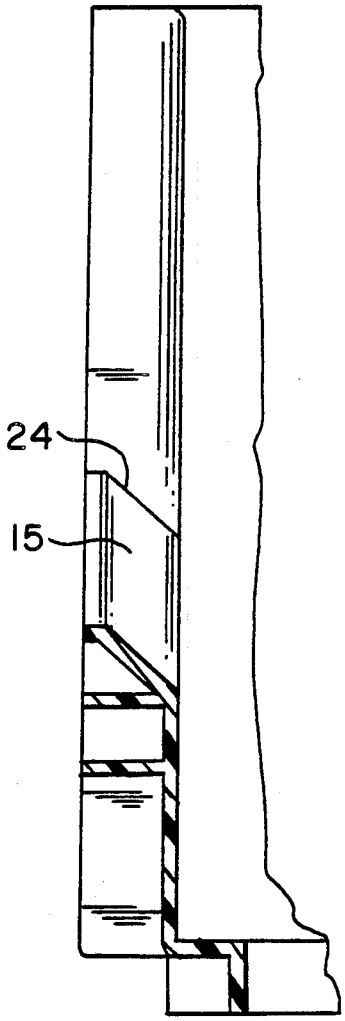
FIG. 7 is a sectional view taken through line 7—7 of FIG. 2.

The longitudinal sides 10 and 12 seen in FIGS. 1 and 2 are comprised of two longitudinal side sections 16 and a center panel section 20. Each longitudinal side section 16 is provided with an intermediate recess 15 that facilitates removal of cartons or bottles from the beverage cases 2 when in a stacked mode. Reinforcing ribs 22 extend horizontally along the center panel section 20 between the respective longitudinal side sections 16 and follow the contour of the longitudinal side section 16. The upper edge 24 of the center panel section 20 including the recessed section 15 is inclined upwardly from the inner edge at an angle of about 30°, best seen in FIG. 7. The upper edge 24 of the central panel section 20 is at an elevation between one-half and one-third the height of the beverage case 2. The recess section 15 is less than one-third the height of the beverage case 2.

Figure 3:
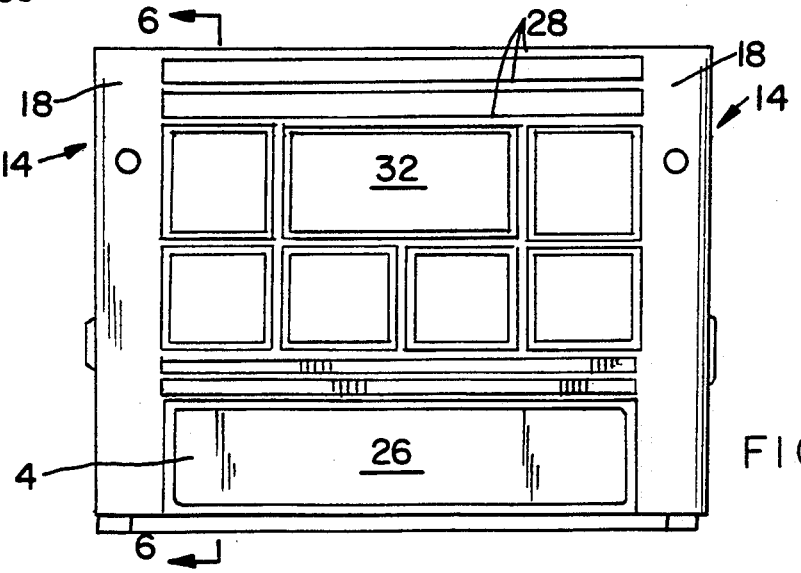
FIG. 3 is an elevational view of the lateral side of the beverage case of FIG. 1.

The lateral sides 6 and 8, seen in FIGS. 1 and 3 are comprised of two lateral side sections 18 and a central panel section 26. The lateral sides 6 and 8 also include horizontal reinforcement ribs 28, vertical reinforcement ribs 30 and a handle opening 32. The upper edge 34 of the lateral sides 6 and 8 is inclined outwardly and downwardly at an angle of about 5° to 10° as best seen in FIG.

6. Similarly, the bottom edge 38 of each lateral side 6 and 8 is inclined downwardly and outwardly at the same angle as upper edge 34.

Figure 4:
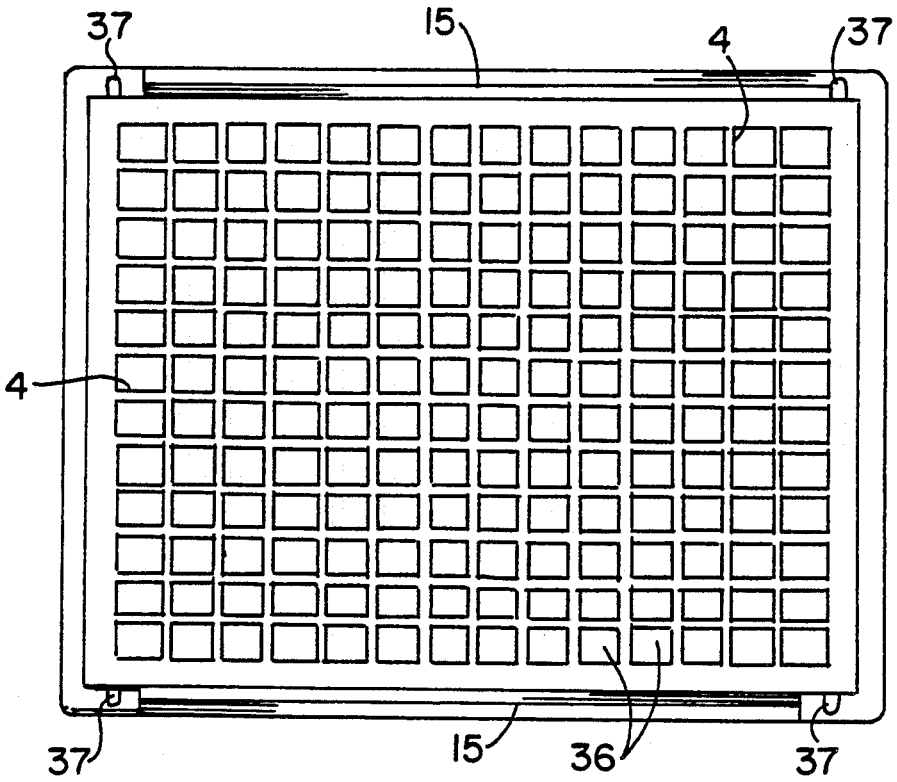
FIG. 4 is a plan view of the beverage case of FIG. 1 taken from the top.
Figure 5:
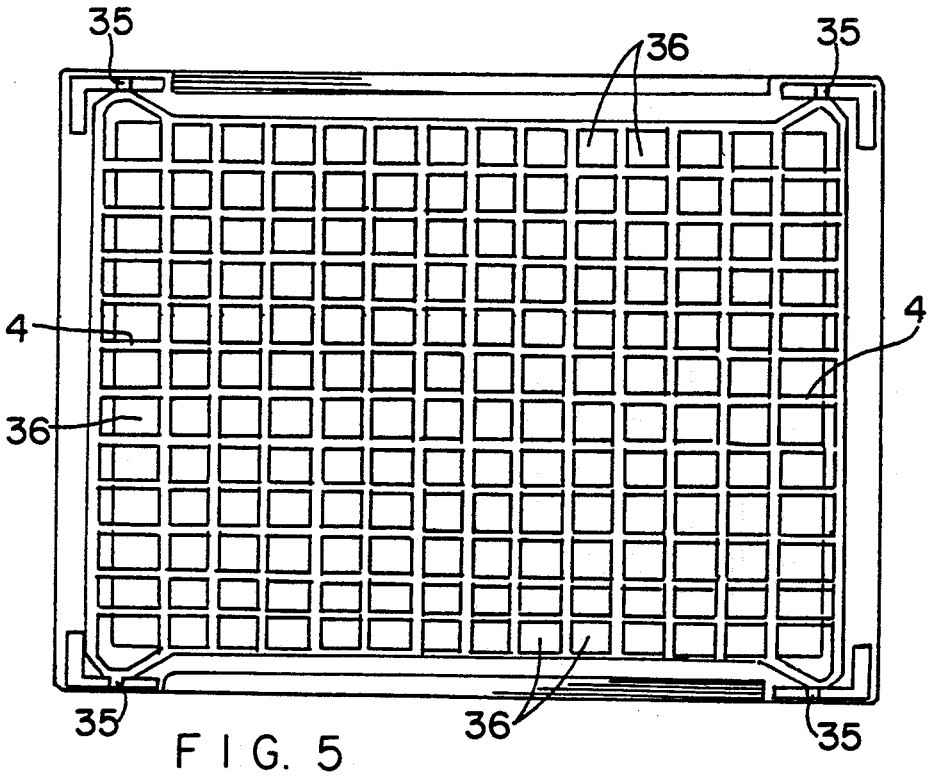
FIG. 5 is a plan view of the beverage case of FIG. 1 taken from the bottom.
Figure 6:
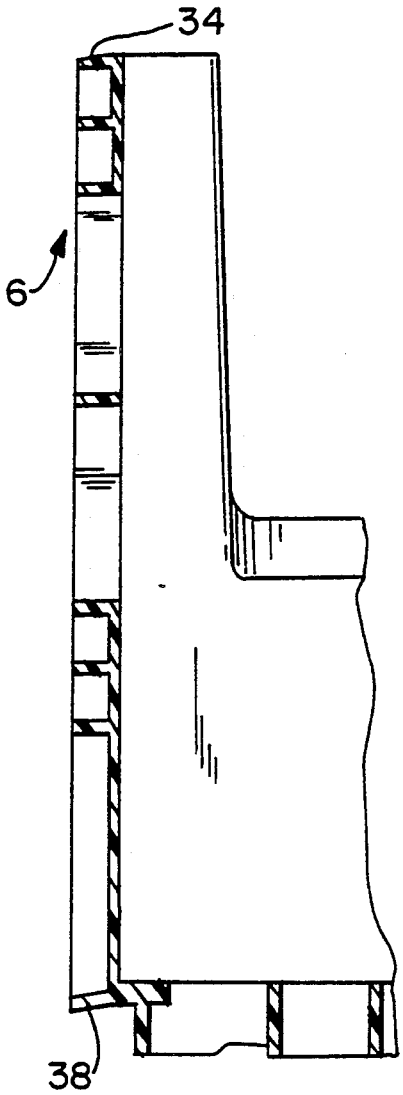
FIG. 6 is a sectional view taken through line 6—6 of FIG. 3.
Figure 8:
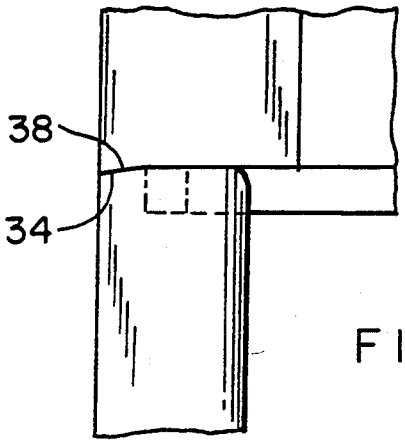
FIG. 8 is a partial elevational view of a top and bottom reinforced corner of a stack of beverage cases.
Figure 9:
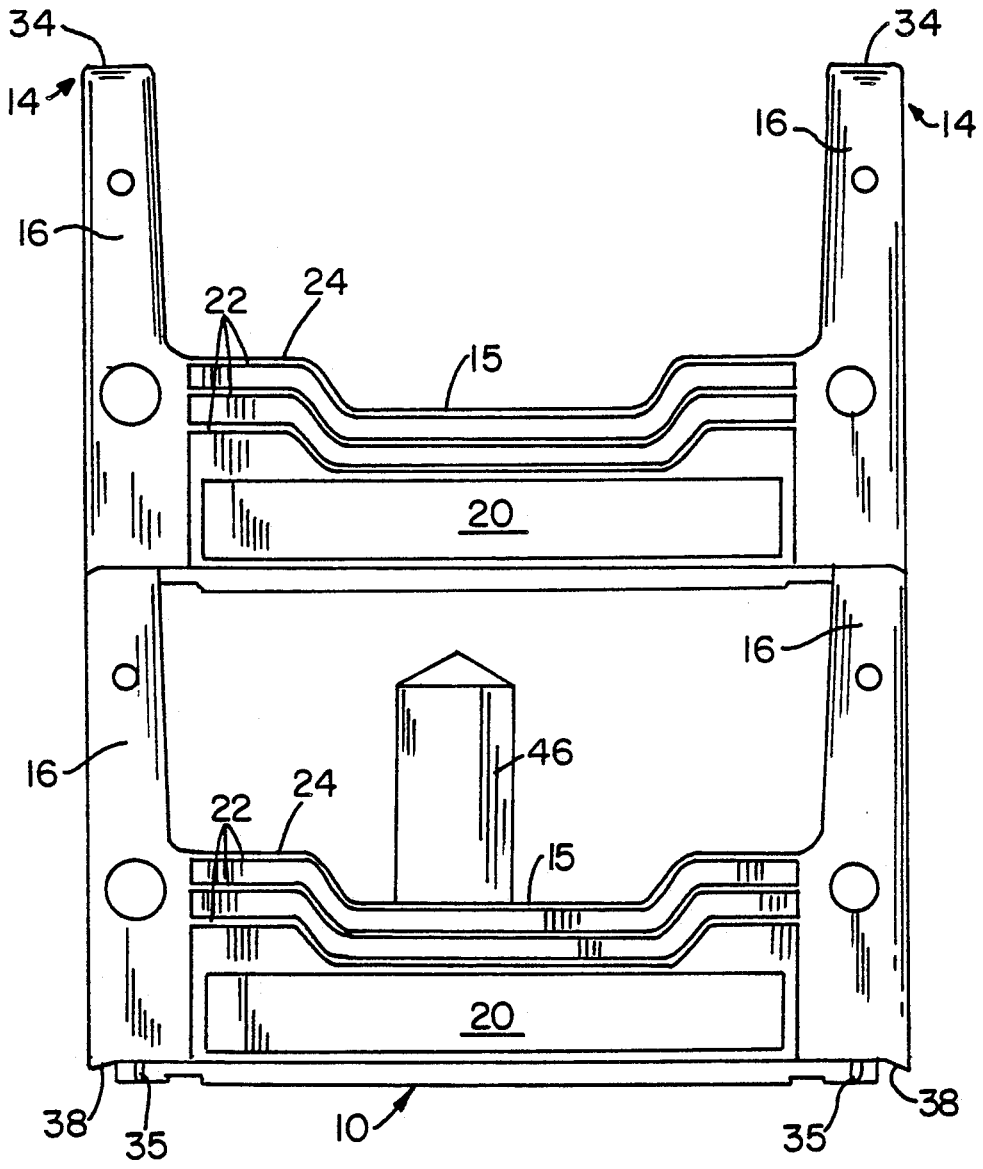
FIG. 9 is an elevational view of two stacked beverage cases.

The container support surface 4 of beverage case 2, best seen in FIGS. 4 and 5, is at the bottom of the beverage case 2 and is configured in a mesh with opening 36 to reduce the weight of the beverage case and afford drainage. A stacking rim 36 is formed on the bottom of the beverage case 2 at a location aligned with the inner edge of the upper edge 34 of the lateral sides 6 and 8 and the inner edge of the reinforcing members 14. The location of the stacking rim 36 provides a means for facilitating stacking of the beverage cases 2 as seen in FIGS. 8 and 9.

In addition, four downwardly depending extensions 35 are provided at the bottom of the beverage case. Four mating recesses 37 are provided at the top of the beverage case 2 in alignment with the four extensions 35. In the stacked mode the extensions 35 fit into the recesses 37 and cooperate with the rib structure and inclined edges extending among the lateral sides to secure the column and provide the structural rigidity required to enable the beverage cases 2 to withstand the forces imposed on the beverage cases 2 during the handling typically associated with beverage cases.

Figure 10:
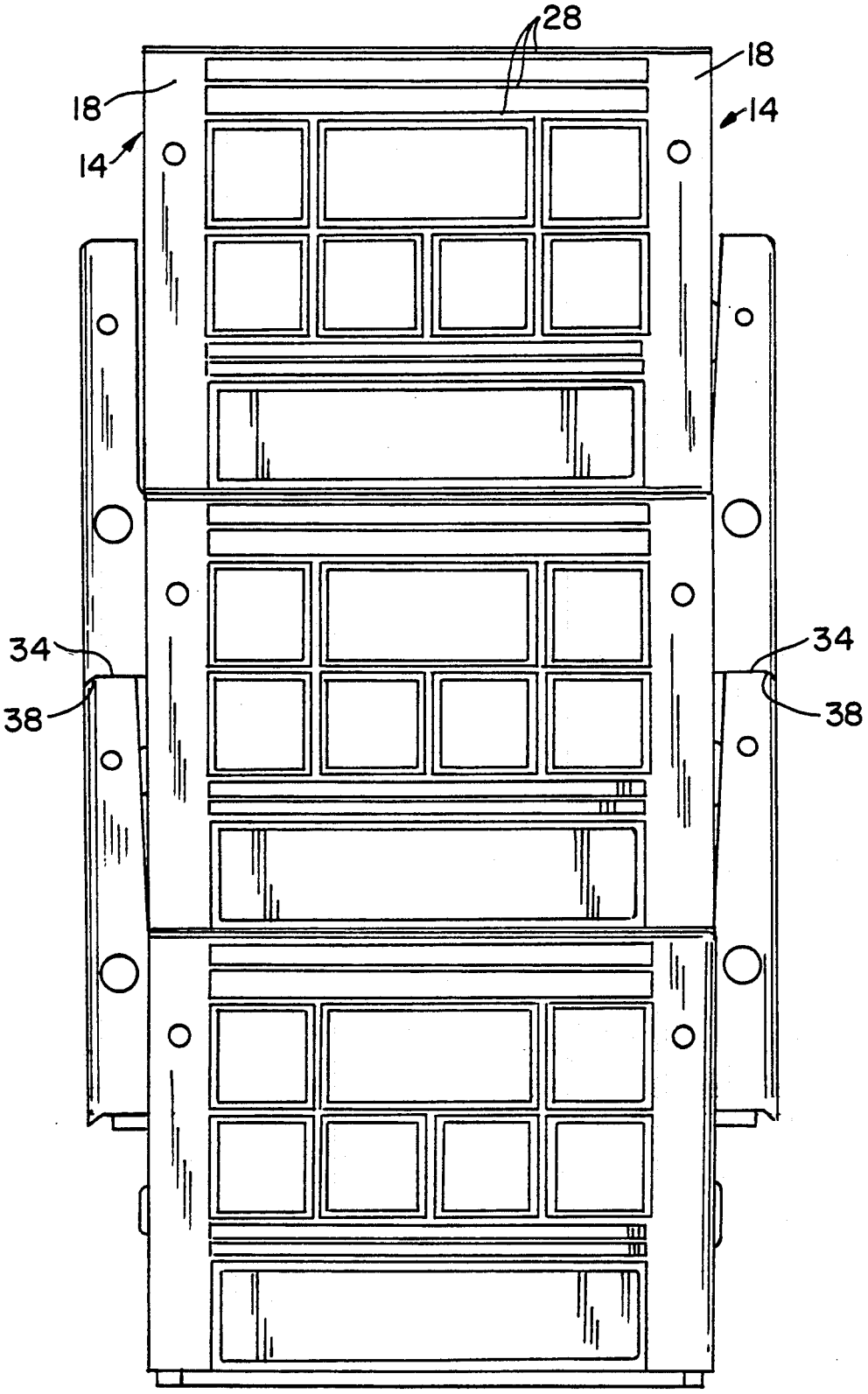
FIG. 10 is an elevational view of the beverage cases of this invention in a rested mode.

As seen in FIG. 10, the beverage cases 2 can be nested by placing alternating cases transversely in the opening defined by the short height longitudinal sides 10 and 12. Thus, nine beverage cases 2 can be nested at the same height as five loaded stacked beverage cases 2. The nested beverage cases 2 use the same securement means as the stacked beverage cases 2; i.e. beveled edges 34 and 38 in abutting relationship the stacking rim 36 inside the inner edge of the top of the lateral sides and the extensions 35 adapted to enter the recesses 37. In effect, two stacked columns 40 and 42, oriented transversely to each other, are formed in the nested mode.

In addition, the recesses 15 in the short height longitudinal sides 10 and 12 facilitate removal of single beverage containers from any of the beverage cases in a stacked column. The top of the beverage container is simply pulled outwardly over the edge 25 of the recess 15 in the longitudinal center panel section 20 at an angle sufficient to clear the bottom of the beverage case 2 above the beverage container being removed. FIG. 9 depicts a milk carton 46 in stacked beverage cases 2 illustrating the clearance available to remove the milk carton 46 without destacking the column.

Practice has shown that a beverage case 2 having a height of eleven and one-half inches, having longitudinal sides 10 and 12 seventeen inches long, lateral sides 6 and 8 thirteen and one-half inches long, longitudinal center panel sections 20 five inches in height from the bottom of the beverage case 2 and a minimum distance between edges 44 of the respective longitudinal reinforcing member sides 16 of just greater than thirteen and one-half inches with intermediate recesses 15 in the longitudinal sides 10 and 12 three and five-eighths inches high and approximately four and five-eighths inches long will provide the benefits of the invention.

The term beverage container is used generally and synonomously to mean beverage cartons, beverage bottles and any other container suitable for storage in a beverage case 2.

I claim:

1. A rectangular beverage case that can be stacked or nested comprised of
   (a) two lateral sides extending the full height of the beverage case;
   (b) two longitudinal sides having center panel sections that extend upwardly from the bottom of the beverage case in height less than one-half the height of the lateral sides, said center panel section of both longitudinal sides having a length greater than the length of the lateral sides and an intermediate recess, the upper edge of which extends below the upper edge of the remaining portion of the center panel of the longitudinal sides;
   (c) vertical reinforcing members at each corner of the beverage case; and
   (d) a surface at the bottom of the beverage case to support beverage containers.

2. A rectangular beverage case as in claim 1 further comprising horizontal reinforcing ribs on the longitudinal sides.

3. A rectangular beverage case as in claim 2 further comprising horizontal and vertical reinforcing ribs on the lateral sides of the beverage case.

4. A rectangular beverage case as in claim 3 further comprising centrally disposed handles in the lateral sides.

5. A rectangular beverage case as in claim 1 further comprising a beveled upper edge on the lateral sides; an angled lower edge at the same angle as the beveled upper edge located on the lateral sides and a stacking rim on the bottom of the beverage case at a location aligned with the inner edges of the lateral sides.

6. A rectangular beverage case as in claim 5 further comprising extensions depending from the bottom of the beverage case and recesses in the top of the beverage case aligned with the depending extensions.

7. A rectangular beverage case as in claim 6 wherein the extensions depending from the bottom of the beverage case are four depending extensions, one of which is located on each side of the beverage case and the recesses are four, each of which is on an upper surface of the beverage case.

8. A rectangular beverage case as in claim 1 further comprising inclined edges on the longitudinal sides of the beverage case that extend upwardly and outwardly from the beverage case.

9. A rectangular beverage case as in claim 8 wherein the upwardly outwardly inclined edge of the longitudinal sides is at an angle of 30° C.

* * * * *